US006143968A

United States Patent [19]

Tonon

[11] Patent Number: 6,143,968

[45] Date of Patent: Nov. 7, 2000

[54] METHOD AND APPARATUS FOR THE VIBRATION OF REEDS

[76] Inventor: Thomas S. Tonon, 35 Birch Ave., Princeton, N.J. 08542

[21] Appl. No.: 09/110,823

[22] Filed: Jul. 6, 1998

Related U.S. Application Data

[63] Continuation-in-part of application No. 08/653,133, May 24, 1996, Pat. No. 5,824,927.

[51] Int. Cl.[7] ..... G10D 11/00

[52] U.S. Cl. ..... 84/375; 84/363; 84/350; 84/383 A

[58] Field of Search ..... 84/350, 363, 375, 84/383 A

[56] References Cited

U.S. PATENT DOCUMENTS

| | | | |
|---|---|---|---|
| 314,234 | 3/1885 | Gally | 84/363 |
| 5,182,413 | 1/1993 | Epping | 84/377 |

*Primary Examiner*—Robert E. Nappi
*Assistant Examiner*—Shih-yung Hsieh
*Attorney, Agent, or Firm*—George E. Kersey, Esq.

[57] ABSTRACT

Tone production by a vibratable reed having a plurality of separated edges disposed in a slot extending between opposed surfaces, with the edges conjoined beyond one end of the slot and extending into and above the opposed end of the slot allowing vibration during bi-directional air flow and alterations in timbre.

19 Claims, 8 Drawing Sheets

METHOD AND APPARATUS FOR THE VIBRATION OF REEDS

This invention relates to vibration of reeds, and more particularly to vibration of reeds for musiocal instruments, and is a continuation-in-part of Ser. No. 08/653,133 filed May 24, 1996, now U.S. Pat. No. 5,824,927.

BACKGROUND OF THE INVENTION

Vibratable reed are used in such musical instruments as accordions, melodeons, concertinas, harmonicas, harmoniums, and melodicas.

The reed in such instruments usually consist of a strip of metal, or tine, fixed at one end, as in a cantilever, and its vibration in air produces a source frequence that is determined largely by the geometric and elastic properties of the reed. All surfaces of the reed, except the fixed end, are in contact only with air.

Thus, the vibration of the reed is "free." Other reeds, called "beating" reeds, contact immovable surfaces during vibration, periodically opening and closing a port. This creates resonance in an air column whose natural vibrational frequency largely determines the pitch of the resulting musical tone.

An example of beating reeds is found in some organ pipes consisting of metal, and the vibrations of both the air column in the pipe and the reed coicide for enhanced creation of a musical tone.

In music, pitch is a characteristic of a tone, or sound, that allows placement of the tone in an ordered musical scale with other tones. A tone is an element of sound determined by the frequency of vibration of sound waves reaching the air, so that the higher the freuency the higher the pitch.

Timbre is a characteristic of a tone that distinguishes the tone from other tones having the same pitch and loudness, and can be described, at least in part, by the relative magnitudes of overtones making up the tone.

In some free reed instruments, the flow of air is bi-directional, i.e. into and out of the instrument. In such cases, it is desirable for the resulting musical tone to have the same combination of pitch and timbre for both flow directions of flow.

A single, conventional reed cannot function with air flow in both directions. Because of the asymmetry of reed construction, with only one edge of a quiescent reed projecting above the surface of a reed plate, away from the reed slot, air flow can activate the reed from only one direction. It is thus necessary to construct such instruments with one set of conventional reeds for inflow, and another set for outflow. The larger reeds of these instruments usually contain one way valves, or leather flaps, that shut off air to the inactive reed and prevent air leakage. This occurs when the direction of air flow cannot support vibration in that reed. There is thus a duplication of reed construction in such instruments in conventional, single action reed design.

In addition, the need for leather flaps often can be troublesome. The flaps often hang up on nearby surfaces, cause changes in tuning as they age, and even cause changes in musical pitch when increased air flow bends the flaps further away from the reed slot.

The timbre of the musical tone produced by a vibrating free reed can depart from the pure tone of a sinusoidal vibration because of sudden, step-like air pulses against the reed as the pulses passes through the slot of the reed plate. Such pulses contain many overtones, which greatly affect timbre. The conventional free reed contains only a single edge that chops the air flow in step-like fashion, and the single moving edge produces an unalterable pattern of pulses. Thus, the freedom to vary the musical timbre is restricted by the single edge design of the conventional reed.

The parent patent application, of which this is a continuation-in-part, concerns novel methods of construction for free reed instruments to allow modification of the pitch and/or timbre of the reed. Previously such modifications were not practical, in view of conventional free reed instrument construction. Such construction can present some difficulty in applying the techniques of the parent patent application. In particular, air leakage through an inactive reed and the use of leather flaps complicate implementation, particularly on small reeds. In addition, when direct contact to a reed is employed in accordance with the parent invention, any presence of a leather flap interferes with the implementation. Additionally, reed duplication required by conventional design also requires duplication of construction when implementing the direct contact methods of the parent invention.

Accordingly, it is an object of this invention to improve the performance and versatility of free reeds in musical instruments. Another object is to allow single reeds to operate with the same combination of pitch and timbre for both directions of air flow.

Another object of this invention is to eliminate the need for leather flaps and improve the timbre of the resulting tone. A further object is to provide a greater range of timbre than is achievable with the vibrations of conventional free reeds. Still another object is to facilitate methods of construction described in the parent invention.

SUMMARY OF THE INVENTION

In accomplishing the foregoing and related objects, the invention provides for producing a tone by a member containing a slot extending between a top surface and a bottom surface, with a vibratable reed attached to the member having a plurality of separated edges disposed in the slot.

In accordance with one aspect of the invention, the separated edges of the reed form a plurality of opposed tongues, which flare outwardly from the attachment of the reed to the member. The tongues can converge to a position where the reed is attached to the member.

In accordance with another aspect of the invention, the reed is selected from the class consisting of two, three, four and more tongues. A pair of the tongues can be connected together over their length from their point of attachment to the member. The tongues can be connected together by a wedge having a width which is less than that of any of the tongues. Air can pass through the slot for causing vibration of the reed. Passage of the air through the slot can be from a bottom surface to a top surface, and the vibration can produce a plurality of pulses of air through the slot during each vibratory cycle of the reed.

In accordance with a further aspect of the invention, a first edge extends from the slot above a top surface when the reed is quiescent, and a second edge extends from the slot below a bottom surface when the reed is quiescent.

Each of the edges can be joined to a common base fixed to the member.

In a method of the invention for producing tones in a musical instrument, the steps include (a) attaching a vibratable reed having a plurality of edges within a slot of a member having opposed ends, and (b) causing vibration of the reed by the passage of air alternatively from a first to a second of the opposed ends, and from the second to the first of the opposed ends.

In a method of the invention for manufacturing a tone-producing device, the steps include (a) attaching a vibratable reed having a plurality of edges within a slot of a member having opposed ends with one of the edges extending outside the first end when the reed is motionless, and a second of the edges extending outside the second end when the reed is motionless. A further step includes attaching the edges to a common position beyond the slot.

The method of the invention for producing tones in a musical instrument includes attaching a vibratable reed having a plurality of edges to a plate with a slot having a first end and a second end, and causing vibration of the reed by the action of air passing through the slot, such that more than two pulses of air pass through the slot during one cycle of vibration of the reed.

The number of edges is chosen to produce a desired musical tone, and one of the edges is situated outside the first end when the reed is motionless, and a second edge is situated outside the second end when the reed is motionless. Each of the edges can be joined to a common base, with the common base fixed to the plate.

The invention makes use of a reed with furcation, or multiple edges. In the simplest case, there is a bifurcated periphery of the reed. This bifurcation enables each of the two edges of the quiescent reed to protrude slightly away from either side of the reed slot. With such construction, air can flow through the slot in a direction starting from either side of the slot and cause the edge of the reed to enter the slot, thus initiating reed vibration.

The quiescent two-sided reed is thus primed to move, regardless of air flow direction through the reed slot. Since this single reed is always active, for both directions of air flow, duplicate construction is no longer necessary, and the need for a leather flap to serve as a one-way valve is eliminated. Additional adaptations of the invention can include any number of edges on the periphery of the reed. Since the number of edges on the reed determines the number and duration of step-like air pulses that pass through the slot, a desirable timbre can be achieved by properly selecting the number of edges, their dimensions, and their location on the reed.

BRIEF DESCRIPTION OF THE DRAWINGS

Other aspects of and advantages of the invention will become apparent after considering several illustrative embodiments, taken in conjunction with the drawings, in which.

DETAILED DESCRIPTION

Figure 1C:
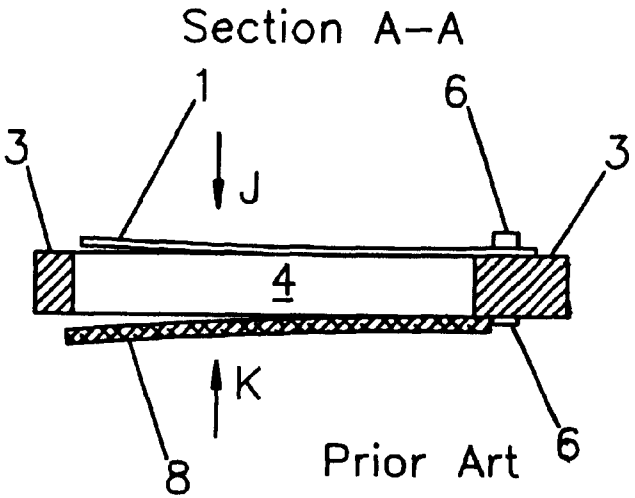
Prior Art Fig. 1C
FIG. 1C is a sectional side view taken along the lines A—A of the reed unit of FIG. 1A.
Figure 1A:
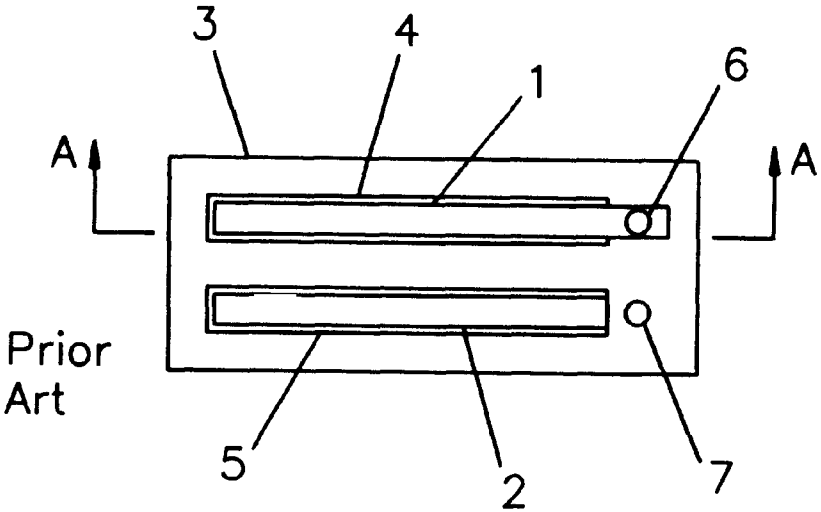
Prior Art Fig. 1A
FIG. 1A is a top view of a free reed unit used in many free reed musical instruments of the prior art.
Figure 1B:
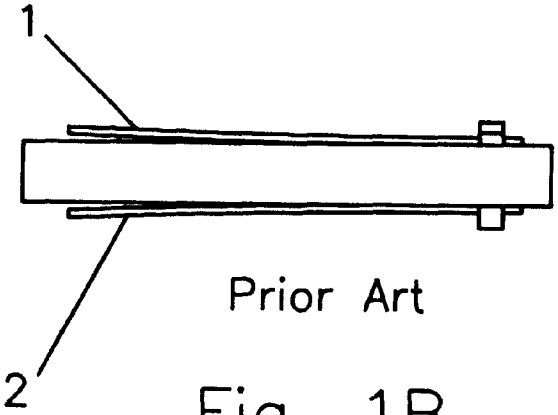
Prior Art Fig. 1B
FIG. 1B is a side view of the reed unit of FIG. 1A.

With reference to the drawings, FIG. 1A shows a top view of a conventional free reed unit, with a reed 1 and a reed 2 mounted on a reed plate 3 by respective rivets 6 and 7. Reed 1 is mounted over a slot 4 cut into the reed plate 3, and reed 2 is mounted over a slot 5. The side view in FIG. 1B shows that reeds 1 and 2 of FIG. 1A have each a single edge. For simplicity, the leather flaps often present on conventional reeds are not shown in FIGS. 1A and 1B, but one leather flap 8 is shown in FIG. 1C.

In FIG. 1C one end of reed 1 is riveted to the reed plate 3 by a rivet 6, and the other end of reed 1 is at a rest position above the top surface of reed plate 3, over the slot 4. Leather flap 8 has one end fastened to the reed plate 3 at a position near the rivet 6. The other end of the flap 8 is pulled away from the lower surface of the reed plate 3, just below the slot 4.

When air pressure above the reed plate 3 is greater than that below the reed plate 3, reed 1 vibrates, with air flow in the direction of the Arrow J, from top to bottom, through the slot 4. When reed 1 is in the position shown in FIG. 1C, and an air pulse rushes underneath reed 1 and enters the slot 4, this causes a pulse in air flow velocity, and because of Bernoulli's principal, a drop in pressure on the underside of reed 1.

Because of the unbalanced pressure, the single edge of reed 1 is pushed downwardly into the slot 4. This air flow also causes the leather flap 8 to move downwardly, away from slot 4, causing little air flow resistance. When reed 1 is inside slot 4, air flow is essentially cut off, and the forces of unbalanced pressure on reed 1 are greatly reduced. The prevailing pressure difference across the reed plate 3, and the momentum imparted to reed 1, however, propel the single edge of the reed further downwardly and outside the bottom of slot 4. This again allows a pulse of air through slot 4, and another flow velocity pulse.

Eventually, the momentum of reed 1 dwindles to zero, accompanied by a maximum value of the reed's potential energy, by virtue of the elasticity of the reed. The air flow caused by the pressure difference across the reed plate and flowing through the bottom of slot 4 is insufficient to maintain reed 1 in its bent position below slot 4, and the reed begins moving upward, again through slot 4, again cutting off air flow. Conversion of potential energy to kinetic energy continues, and reed 1 emerges out of the top of slot 4, causing a pulse of air to again rush into slot 4, with a characteristic pulse in flow velocity. The momentum of reed 1 carries the reed further upward, until another position of maximum potential energy is reached, at which point, reed 1 again proceeds downward, assisted by unbalanced pressure forces, to begin a new cycle of vibration. Reed 1 cannot vibrate when air flow through slot 4 is upward, in the direction of Arrow K in FIG. 1C. With air flow upward, reed 1 is merely bent slightly further away from the top surface of reed plate 3, in a stable position, with no mechanism for cyclic excitation.

When air flow is attempted in the direction depicted by Arrow K of FIG. 1C, leather flap 8 is forced upward and pinned against the bottom surface of reed plate 3, preventing significant air flow through slot 4. Thus, leather flap 8 serves as a one way valve, allowing air to to flow only downwardly, in the direction of Arrow J in FIG. 1C. Such a flap is necessary for large reeds in order to prevent air loss through reed slots when air flow is not in the direction required for reed vibration. When air pressure across the reed unit 3 of FIG. 1C is upward, reed 2 of FIG. 1A begins to vibrate since it is mounted on the bottom surface of reed plate 3, as depicted in FIG. 1B.

Figure 2B:
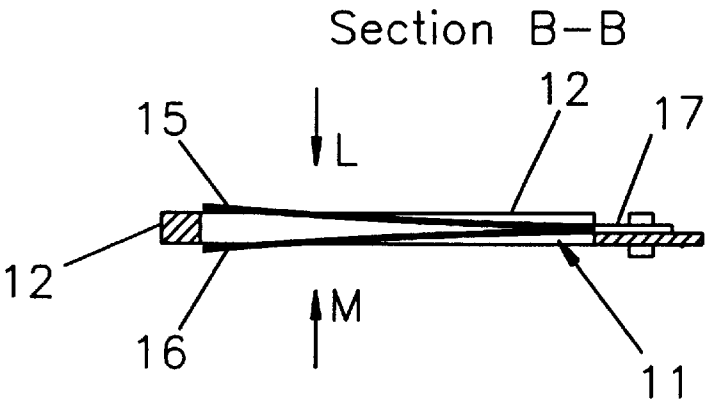
FIG. 2B is a sectional side view taken along the lines B—B of the reed unit of FIG. 2A.
Figure 2A:
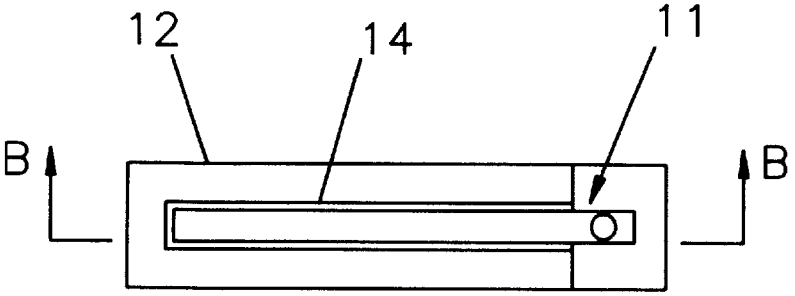
FIG. 2A is a top view of a reed unit in accordance with one adaptation of the present invention.

FIG. 2A is a top view of a bifurcated reed, having two edges, in one adaptation of the invention, showing reed plate 12, with a single reed slot 14. Both edges of reed 11 are shown clearly in the side views of FIGS. 2B and 2C. In the sectional side view of FIG. 2B, reed 11 is shown to consist of bifurcated tongues 15 and 16 that flare out from base 17, which is in turn fastened to reed plate 12 by rivet 13. The rest position of reed 11 is shown in both FIG. 2B and FIG. 2C. Here, the two tongues 15 and 16 of reed 11 protrude away from their respective sides of reed plate 12, providing a mechanism for reed vibration to commence when air flow is in either of the two directions depicted by arrows L and M in FIG. 2B. When air flow is in the direction of arrow L, tongue 15, with its corresponding edge, behaves in the way explained for the single-edge prior art reed 1 of FIG. 1C. When air flow is in the direction of arrow M, tongue 16, with its corresponding edge, behaves in the way explained for the single-edge prior art reed 1 of FIG. 1C. It is thus shown how a two-edge free reed can be made to operate during both directions of air flow, and thus, one of these (double acting) reeds can replace two conventional, single acting reeds.

In addition, since the same reed accommodates both air flow directions, air slot 14 of FIG. 2B is active during both air flow directions, and there is no need for a one way valve to limit air leakage through an unused air slot. It is thus shown how a bifurcated, or two-edge, free reed can be made to eliminate the need for one way valves, and the complications in construction that they require.

Figure 2C:
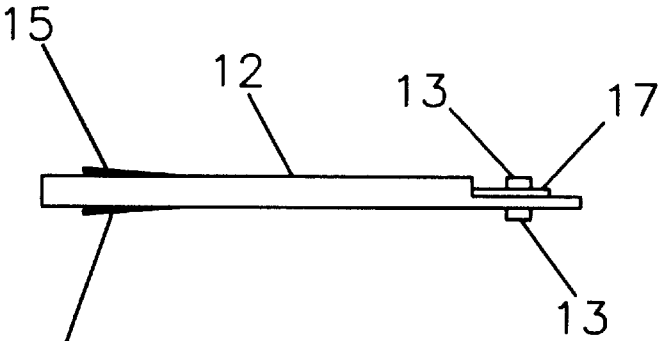
FIG. 2C is a side view of the reed unit of FIG. 2A.

The simplicity of construction shown in FIGS. 2A, 2B, and 2C, with a single, exposed, reed without leather flaps greatly facilitates the implementation of methods described in the parent application.

Figure 3A:
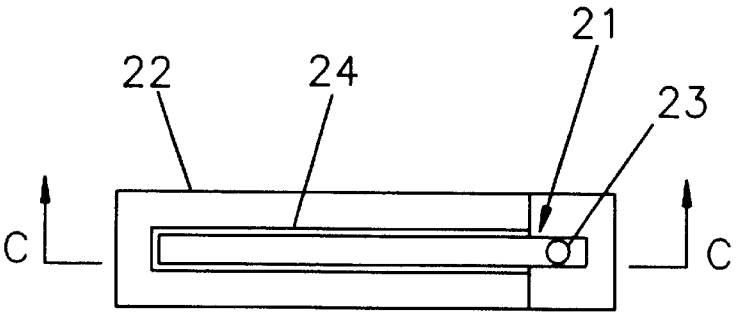
FIG. 3A is a top view of a reed unit in accordance with another adaptation of the invention.
Figure 3B:
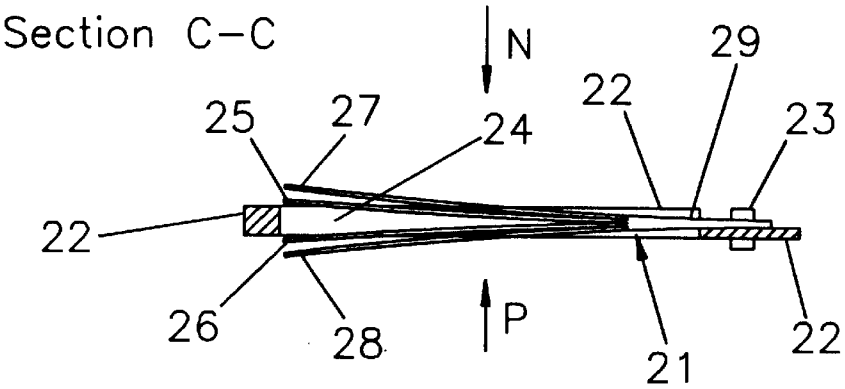
FIG. 3B is a sectional side view taken along the lines C—C of the reed unit of FIG. 3A.

FIG. 3A shows a top view of a four-furcated, or a four-edge, free reed, in accordance with the invention, where reed 21 is fastened at one end by rivet 23 over slot 24 in reed plate 22. FIG. 3B is a cross sectional side view, showing reed 21 to consist of base 29, which is fastened to reed plate 22 by rivet 23, and four tongues 25, 26, 27, 28 fanning out from base 29, with each tongue providing its own separate edge to interact with the air stream. The rest position of this four-edge reed 21 is depicted in FIG. 3B, with the two tongues 25 and 26 of reed 21 protruding away from their respective sides of reed plate 22, providing a mechanism to begin reed vibration when air flow is in either of the two directions depicteed by arrows N and P in FIG. 3B. When air flow is in the direction of arrow N, tongue 25 behaves in the way explained for the single-edge prior art reed 1 of FIG. 1C. When air flow is in the direction of arrow P, tongue 26 behaves in the way explained for the single-edge prior art reed 1 of FIG. 1C.

Tongues 27 and 28 of FIG. 3B protrude away from reed plate 22 even more than sister tongues 25 and 26 and affect the timbre of the musical tone emanating from the reed when the amplitude of vibration is large enough to cause either tongue 27 or tongue 28 to enter reed slot 24 with sufficient kinetic energy. Such entry of tongues 27 and 28 first shuts off air flow, or extends the shut off initially produced by tongue 25 or tongue 26, respectively, thus changing the pattern of step-like air flow pulses that would otherwise occur in the absence of this entry. Changing the pattern of air flow pulses affects the timbre of the musical tone. The distance between the free tip of tongue 27 and that of tongue 25, and the distance between the free tip of tongue 28 and that of tongue 26 are design parameters that can be used to affect the timbre of the musical tone. These distances need not be equal, and during vibrations, are affected by dynamical aspects of the geometry. If either of these distances are greater than the thickness of reed plate 23, when the tongues are moving towards slot 24, at the larger amplitudes of vibration, an additional pulse of air will flow, causing a pulse that would not otherwise be present during vibration. Thus shown is how additional free reed edges can provide a timbre controlled musical tone.

Figure 4A:
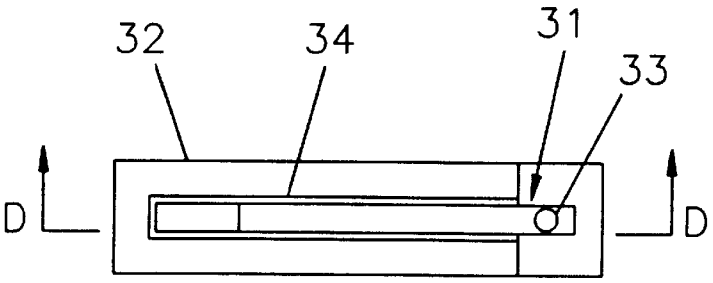
FIG. 4A is a top view of a reed unit in accordance with a further adaptation of the invention.
Figure 4B:
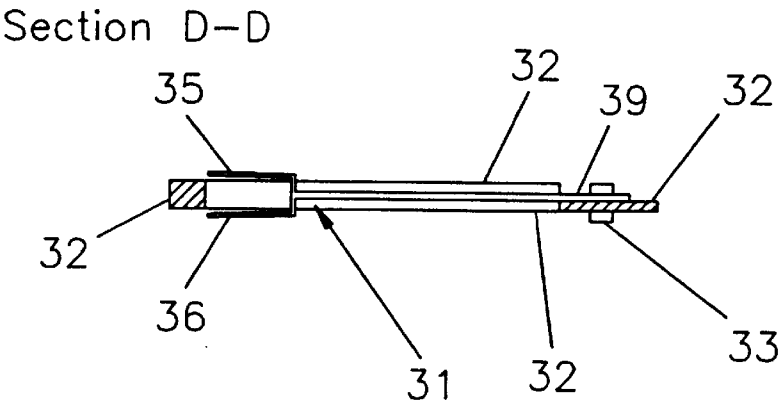
FIG. 4B is a sectional side view taken along the lines D—D of the reed unit of FIG. 4A.

FIGS. 4A and 4B illustrate another example of a two-edge reed, used in accordance with the invention. FIG. 4A is a top view showing reed 31 mounted over slot 34 and held in place on plate 32 at one end by rivet 33. FIG. 4B is a cross sectional side view of FIG. 4A and shows clearly the two edges 35 and 36 of reed 31. Edges 35 and 36 are attached to a common base 39, which is riveted to plate 32 by rivet 33. FIG. 4B shows reed 31 in rest position, with edge 35 protruding slightly above reed plate 32 and edge 36 protruding slightly below reed plate 32. These protrucing edges allow reed 31 to vibrate when air flows in either direction through slot 32, and thus, a single reed, as constructed according to FIGS. 4A and 4B, can replace two conventional reeds, without the need for leather flaps. Edges 35 and 36 provide a means to affect airflow pulses when reed vibration is sufficiently large, and the action of reed 31 with respect to bidirectional airflow and timbre modification is much the same as that of reed 11, depicted in FIGS. 2A, 2B and 2C.

Figure 5A:
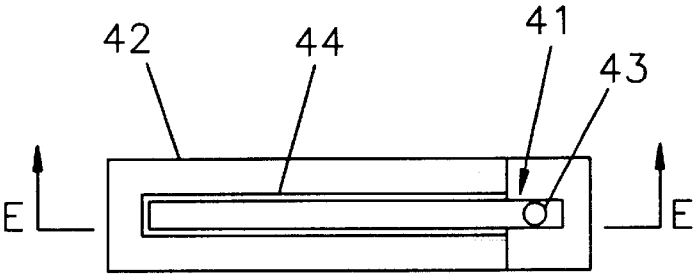
FIG. 5A is a top view of a reed unit in accordance with still another adaptation of the invention.
Figure 5B:
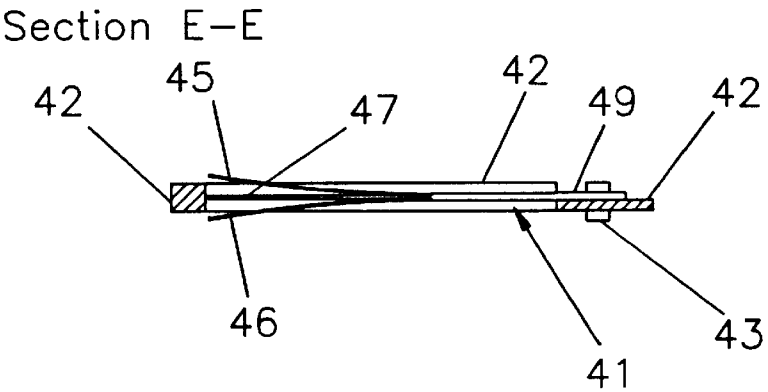
FIG. 5B is a sectional side view taken along the lines E—E of the reed unit of FIG. 5A.

FIGS. 5A and 5B illustrate an example of a triple-edge reed, used in accordance with the invention. FIG. 5A is a top view showing reed 41 mounted over slot 44 and held in place on plate 42 at one end by rivet 43. FIG. 5B is a cross sectional side view of FIG. 5A and shows clearly the three edges 45, 46 and 47 of reed 41. Edges 45, 46, and 47 are attached to a common base 49, which is riveted to plate 42 by rivet 43. FIG. 5B shows reed 41 in rest position, with edge 45 protruding slightly above reed plate 42 and edge 46 protruding slightly below reed plate 42. These protruding edges allow reed 41 to vibrate when air flows in either direction through slot 42, and thus, a single reed, as constructed according to FIGS. 5A and 5B, can replace two conventional reeds, without the need for leather flaps. Edges 45, 46 and 47 provide a means to affect airflow pulses when reed vibration is sufficiently large, in a manner as explained above for previous figures.

Figure 6A:
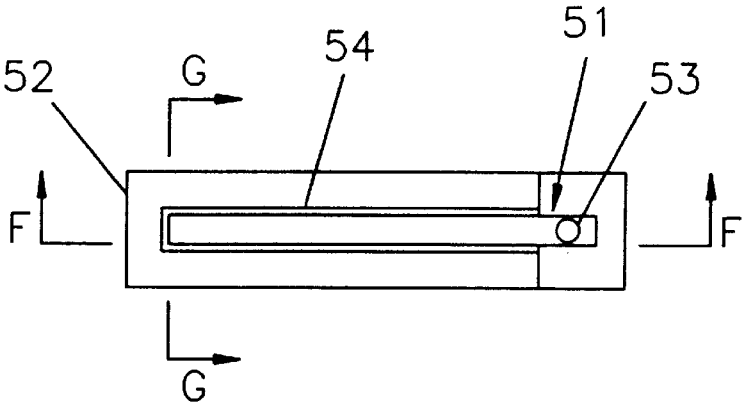
FIG. 6A is a top view of a reed unit in accordance with yet another adaptation of the invention.
Figure 6C:
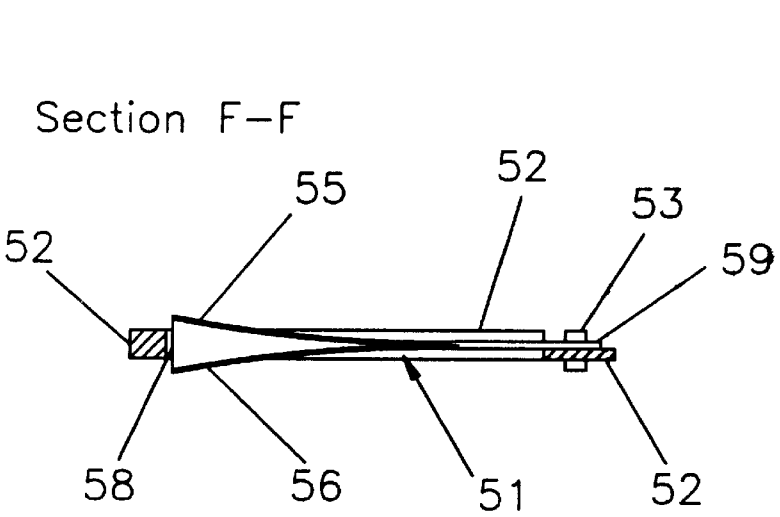
FIG. 6C is a sectional side view taken along the lines F—F of the reed unit of FIG. 6A.
Figure 6B:
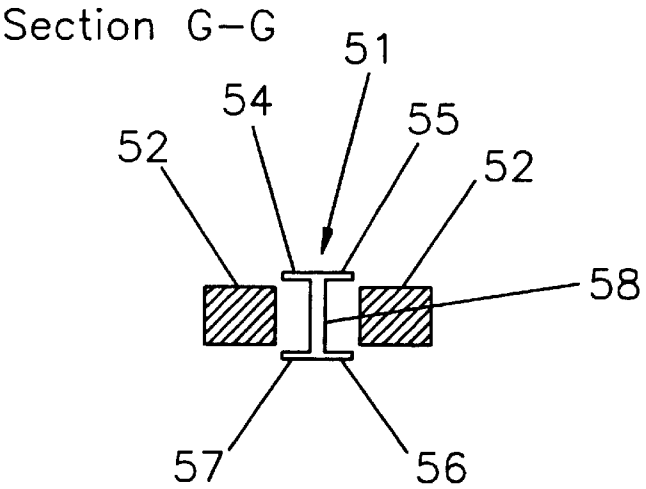
FIG. 6B is a sectional side view taken along the lines G—G of the reed unit of FIG. 6A.

FIGS. 6A, 6B and 6C illustrate an example of a four-edge reed, used in accordance with the invention. FIG. 6A is a top view showing reed 51 mounted over slot 54 and held in place on plate 52 at one end by rivet 53. FIG. 6B is a cross sectional side view of FIG. 6A, showing clearly the four edges 54, 55, 56 and 57 of reed 51. FIG. 6C is a cross sectional side view of FIG. 6A, showing that edges 54, 55, 56 and 57 are attached to a common base 59, which is riveted to plate 52 by rivet 53. FIG. 6C shows reed 51 in rest position, with edge 55 protruding slightly above reed plate 52 and edge 56 protruding slightly below reed plate 52. These protruding edges, as well as edges 54 and 57, which are hidden in FIG. 6C, allow reed 51 to vibrate when air flows in either direction through slot 52, and thus, a single reed, as constructed according to FIGS. 6A, 6B, and 6C, can replace two conventional reeds, without the need for leather flaps. Edges 54, 55, 56 and 57 also provide a means to affect air flow pulses when reed vibration is sufficiently large, in a manner as explained above for previous figures.

Figure 7A:
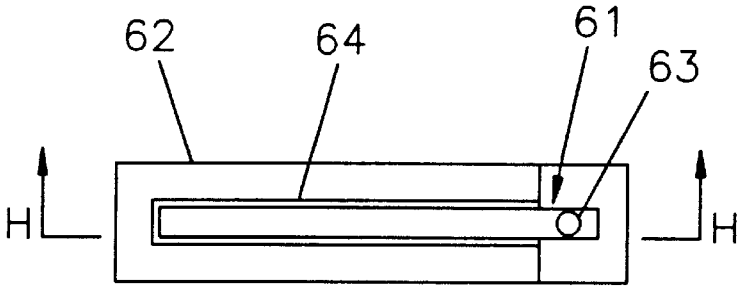
FIG. 7A is a top view of a reed unit in accordance with a further adaptation of the invention.
Figure 7B:
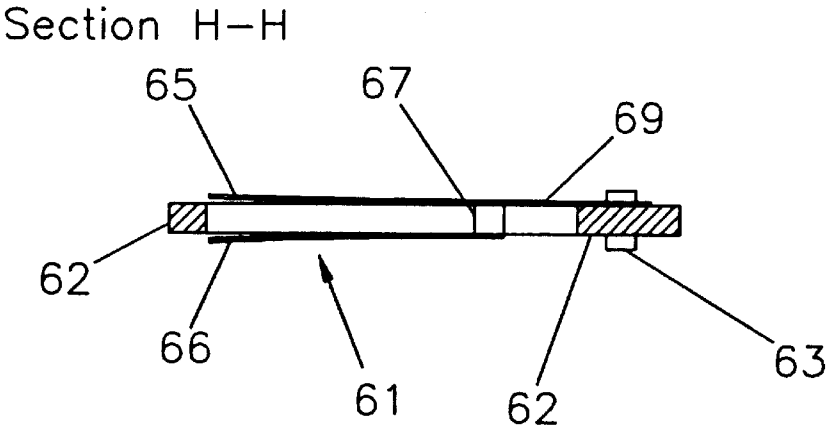
FIG. 7B is a sectional side view taken along the lines H—H of the reed unit of FIG. 7A.

FIGS. 7A and 7B illustrate another example of a two-edge reed, used in accordance with the invention. FIG. 7A is a top view showing reed 61 mounted over slot 64 and held in place on plate 62 at one end by rivet 63. FIG. 7B is a cross sectional side view of FIG. 7A and shows clearly the two edges 65 and 66 of reed 61. Edges 65 and 66 are attached to spacer 67, which is attached to base 69, which is in turn riveted to plate 62 by rivet 63. FIG. 7B shows reed 61 in rest position, with edge 65 protruding slightly above reed plate 62 and edge 66 protruding slightly below reed plate 62. These protruding edges allow reed 61 to vibrate when air flows in either direction through slot 62, and thus, a single reed, as constructed according to FIGS. 7A and 7B, can replace two conventional reeds, without the need for leather flaps. Edges 65 and 66 provide a means to affect airflow pulses when reed vibration is sufficiently large, and the action of reed 61 with respect to bi-directional airflow and timbre modification is much the same as that of reed 11, depicted in FIGS. 2A, 2B and 2C.

Figure 8A:
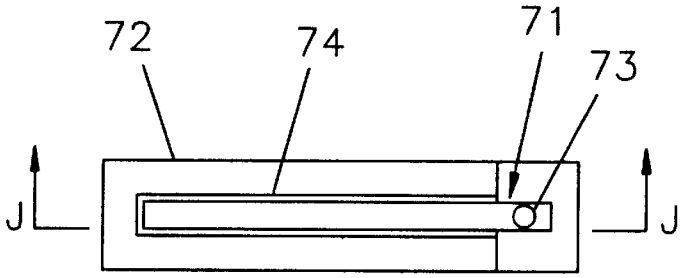
FIG. 8A is a top view of a reed unit in accordance with a still further adaptation of the invention.
Figure 8B:
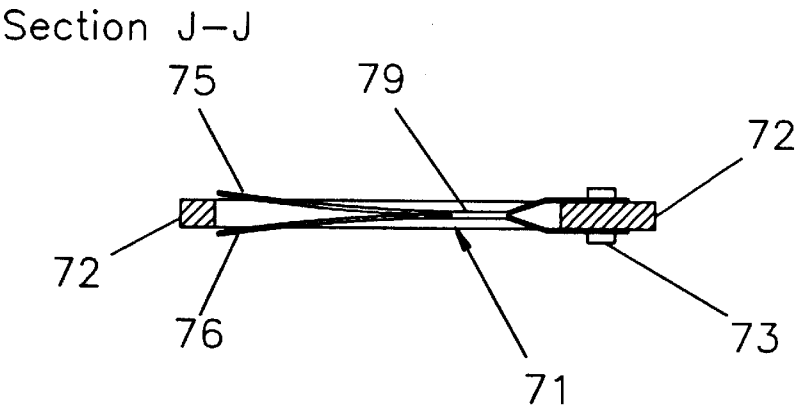
FIG. 8B is a sectional side view taken along the lines J—J of the reed unit of FIG. 8A.

FIGS. 8A and 8B illustrate another example of a two-edge reed, used in accordance with the invention. FIG. 8A is a top view showing reed 71 mounted over slot 74 and held in place on plate 72 at one end by rivet 73. FIG. 8B is a cross sectional side view of FIG. 8A and shows clearly the two edges 75 and 76 of reed 71 wherein the opposed tongues are connected together by a wedge having a width which is less than that of any of the tongues. Edges 75 and 76 are attached to one end of a common base 79, which has its opposite end forked and riveted to plate 72 by rivet 73.

FIG. 8B shows reed 71 in rest position, with edge 75 protruding slightly above reed plate 72 and edge 76 protruding slightly below reed plate 72. These protruding edges allow reed 71 to vibrate when air flows in either direction through slot 74, and thus, a single reed, as constructed according to FIGS. 8A and 8B, can replace two conventional reeds, without the need for leather flaps. Edges 75 and 76 provide a means to affect airflow pulses when reed vibration is sufficiently large, and the action of reed 71 with respect to bidirectional airflow and timbre modification is much the same as that of reed 11, depicted in FIGS. 2A, 2B and 2C.

It will be appreciated that the foregoing description of the invention is illstrative only and that modifications and adaptations of the illustrative embodiments may be made without departing from the spirit and scope of the invention, as defined in the appended claims.

What is claimed:

1. Apparatus for producing a tone, comprising a member containing a slot extending between a top surface and a bottom surface, and a vibratable reed attached to said member having a plurality of separated edges disposed in said slot, wherein said separated edges of said reed comprise a plurality of opposed tongues connected together by a wedge having a width which is less than that of any of said tongues.

2. Apparatus as defined in claim 1, wherein said reed comprises a plurality of facially contacting tongues.

3. Apparatus as defined in claim 2, wherein said tongues at equilibrium flare outwardly from the attachment of said reed to said member.

4. Apparatus as defined in claim 3, wherein said tongues are of equal length in opposition to each other and converge to a position where said reed is attached to said member.

5. Apparatus as defined in claim 2, wherein said reed is selected from the class comprising at least two tongues.

6. Apparatus as defined in claim 2, wherein a pair of said tongues is connected together over a length thereof from their point of attachment to said member.

7. Apparatus as defined in claim 1 further including means for causing vibration of said reed by the passage of air through said slot.

8. Apparatus as defined in claim 7, wherein said means for causing vibration directs air to pass through said slot from said bottom surface to said top surface.

9. Apparatus as defined in claim 8, wherein said means for causing vibration produces a plurality of pulses of air through said slot during each vibratory cycle of said reed.

10. Apparatus as defined in claim 1, wherein said tongues are joined together to a common base, and said common base is fixed to said member.

11. Apparatus as defined in claim 1 wherein said plurality of tongues comprises edges in opposed pairs.

12. Apparatus as defined in claim 1 wherein said plurality of tongues comprises a straight tongue between opposed tongues.

13. Apparatus for producing a tone, comprising a member containing a slot extending between a top surface and a bottom surface, and a vibratable reed attached to said member having a plurality of edges disposed in said slot, wherein a first of said edges extends from said slot above said top surface when said reed is quiescent, and a second of said edges extends from said slot below said bottom surface when said reed is quiescent.

14. The method of producing tones in a musical instrument, comprising the steps of:

(a) attaching a vibratable reed having a plurality of edges within a slot of a member having opposed ends, and (b) causing vibration of said reed by the passage of air through said slot, further including the step of causing vibration of said reed by the passage of air alternatively from a first to a second of said opposed ends, and from said second to said first of said opposed ends.

15. The method of claim 14 for producing tones in a musical instrument further including the step of causing vibration of said reed by the action of air passing through said slot, such that more than two pulses of air pass through said slot during one cycle of vibration of said reed.

16. The method of claim 14, comprising the step of:

attaching said vibratable reed with one of said edges extending outside of said first end when said reed is motionless, and a second of said edges extending outside said second end when said reed is motionless.

17. The method of claim 16 further including the step of attaching said edges to a common position beyond said slot.

18. The method of claim 16 in which the number of said edges is chosen in order to produce a specified musical tone.

19. The method of claim 16 in which each of said edges are joined to a common base, and whereby said common base is fixed to a plate.

* * * * *